US007558732B2

(12) United States Patent
Kustner et al.

(10) Patent No.: US 7,558,732 B2
(45) Date of Patent: Jul. 7, 2009

(54) METHOD AND SYSTEM FOR COMPUTER-AIDED SPEECH SYNTHESIS

(75) Inventors: Michael Kustner, Weyarn (DE); Markus Schnell, Munich (DE)

(73) Assignee: Infineon Technologies AG (DE)

( * ) Notice: Subject to any disclaimer, the term of this patent is extended or adjusted under 35 U.S.C. 154(b) by 423 days.

(21) Appl. No.: 11/086,801

(22) Filed: Mar. 22, 2005

(65) Prior Publication Data

US 2005/0216267 A1 Sep. 29, 2005

Related U.S. Application Data

(63) Continuation of application No. PCT/DE03/03158, filed on Sep. 23, 2003.

(30) Foreign Application Priority Data

Sep. 23, 2002 (DE) ..... 102 44 166

(51) Int. Cl.
*G10L 19/00* (2006.01)

(52) U.S. Cl. ..... 704/260; 704/258; 704/269

(58) Field of Classification Search ..... 704/260, 704/258, 269

See application file for complete search history.

(56) References Cited

U.S. PATENT DOCUMENTS

| | | | | |
|---|---|---|---|---|
| 5,157,759 | A | 10/1992 | Bachenko | |
| 5,924,068 | A * | 7/1999 | Richard et al. | 704/260 |
| 5,930,756 | A * | 7/1999 | Mackie et al. | 704/260 |
| 5,943,648 | A * | 8/1999 | Tel | 704/270.1 |
| 6,029,131 | A * | 2/2000 | Bruckert | 704/260 |
| 7,027,568 | B1 * | 4/2006 | Simpson et al. | 379/88.16 |
| 2003/0061041 | A1 * | 3/2003 | Junkins et al. | 704/254 |
| 2003/0074196 | A1 * | 4/2003 | Kamanaka | 704/260 |

FOREIGN PATENT DOCUMENTS

| | | |
|---|---|---|
| DE | 691 31 549 T2 | 7/2000 |
| WO | WO-00/45373 A1 | 8/2000 |

OTHER PUBLICATIONS

International Preliminary Examination Report based on PCT/DE2003/003158, completion date of report Jul. 16, 2005.

Caroline Frey; "German Word Stress in Optimally Theory"; Journal of Comparative Germanic Linguistics 2: pp. 101-142, 1998.

Dennis H. Klatt; "Synthesis by rule of segmental durations in English sentences"; Frontiers of Speech Communication Research, ed. B. Lindblom and S. Ohman, Academic Press, London, pp. 287-300, 1979.

Klaus J. Kohler; "Zeitstrukturierung in der Sprachsynthese" in: Digitale Sprachverarbeitung, ITG-Tagung Bad Nauheim, hrsg. von A. Lacroix, VDE-Verlag, Berlin, pp. 165-170, 1988.

(Continued)

*Primary Examiner*—Daniel D Abebe
(74) *Attorney, Agent, or Firm*—Dickstein, Shapiro, LLP.

(57) ABSTRACT

Method and system for computer-aided speed synthesis for synthesizing electronic text by performing a predefined series of rules-based analyses in a predefined order, each of the analyses operating in a graduated manner to convert respective electronic text into electronic lexicons, and announcing analog speech based on the results of the performing step.

7 Claims, 7 Drawing Sheets

OTHER PUBLICATIONS

Petra Wagner; "Systematische Uberprufung deutscher Wortbetonungsregein" in W. Hess, K. Stober (Hrsg.), Elektronische Sprachsignalverarbeitung, Tagungsband zur 12. Konferenze 2001, pp. 329-338, 2001.

M. Macchi; "Issues in text-to-speech synthesis"; Intelligence and Systems, 1998, Proceedings, IEEE International Joint Symposia on Rockville, MD, USA, May 21-23, 1998, Los Alamitos, CA, USA, IEEE Comput. Soc. US.; May 21, 1998, pp. 318-325; XP010288887.

Oliver van der Vrecken, et al.; "New techniques for the compression of synthesizer databases"; Circuits and Systems, 1997; ISCAS '97, Proceedings of 1997 IEEE International Symposium on Hong Kong Jun. 9-12, 1997; New York, NY, USA, IEEE; Jun. 9, 1997, pp. 2641-2644,; XP010236271.

Marko Moberg, et al.; "Optimizing speech synthesizer memory footprint through phoneme set reduction"; Proceedings of 2002 IEEE Workshop on Speech Synthesis (CAT. No. 02EX555), Proceedings of 2002 IEEE Workshop on Speech Synthesis, Santa Monica, CA, USA, Sep. 11-13, 2002, pp. 171-174; XP002267880.

Caroline Frey; "German Word Stress in Optimality Theory"; Journal of Comparative Germanic Linguistics; 1998 Kluwer Academic Publishers; pp. 101-142.

* cited by examiner

METHOD AND SYSTEM FOR COMPUTER-AIDED SPEECH SYNTHESIS

CROSS-REFERENCE TO RELATED APPLICATIONS

This application is a continuation of International Patent Application Serial No. PCT/DE2003/003158, filed Sep. 23, 2003, which published in German on Apr. 8, 2004 as WO 2004/029929 A1, and is incorporated herein by reference in its entirety.

FIELD OF INVENTION

The invention relates to a method for computer-aided speech synthesis of a stored electronic text to form an analog speech signal, a speech synthesis device and a telecommunications device.

BACKGROUND OF INVENTION

Artificial speech synthesis is being increasingly used at the present time in order to output information to a user by means of a computer. Speech synthesis is acquiring particular significance as a means of communication for outputting information to people within the scope of systems in which other output media, for example graphics, are not possible for reasons of space, for example because a monitor for presenting information is not available or cannot be used for reasons of space. Particularly for such a case in which other output media cannot be used for reasons of space, there is a need for a speech synthesis device and a method for speech synthesis which make very low demands on available resources in terms of the computing power and in terms of the storage space required and nevertheless provide fully functioning synthesis, for example for "reading out" a text, preferably an electronic message.

Known approaches which are not yet available on integrated systems (embedded systems) owing to their very large demands in terms of the storage space required are usually divided into speech synthesis systems, in which the speech synthesis is based on what is referred to as diphonic synthesis, and into speech synthesis systems which are based on what is referred to as corpus-based speech synthesis.

Even the diphonic synthesis systems for which a relatively small amount of storage space is sufficient require a storage space of approximately 20 Mbytes, and corpus-based speech synthesis systems require up to 1 Gbyte of storage space or more.

This storage space requirement is significantly too large to be able to be implemented in an embedded system.

A text-to-speech converter device in which the text-to-speech conversion is carried out for a described special exception lexicon is described in WO 00/45373 A1.

A parser device for determining predefined expressions from a speech signal sequence which is spoken into it is described in DE 691 31 549 T2.

The invention is based on the problem of providing a speech synthesis which requires a reduced amount of storage space in comparison with known speech synthesis methods or speech synthesis devices.

SUMMARY OF THE INVENTION

The problem is solved by means of the method for computer-aided speech synthesis of a stored electronic text to form an analog speech signal, by means of a speech synthesis device and by means of a telecommunications device having the features according to the independent patent claims.

In a method for computer-aided speech synthesis of a stored electronic text to form an analog speech signal, the stored electronic text is subjected to a text analysis using predefined text analysis rules.

The stored electronic text is usually stored in a predefined electronic text processing format, for example ASCII. In addition, the electronic text can also contain control characters of a text processing system, for example page break control characters or formatting control characters.

This text is converted by means of the method into an analog speech signal which is output to a user by means of a loudspeaker.

DETAILED DESCRIPTION OF PREFERRED EMBODIMENTS OF THE INVENTION

Figure 1:
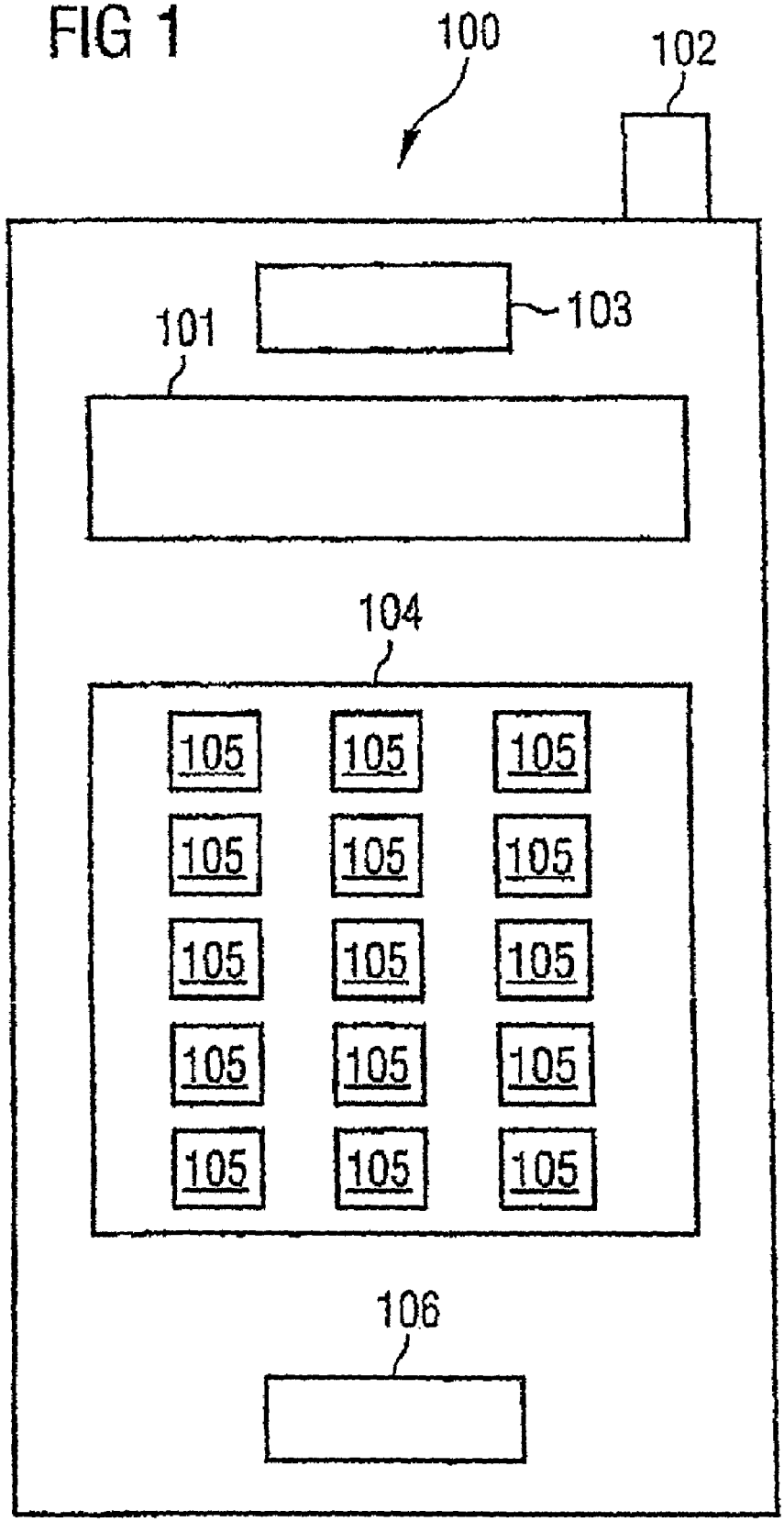
FIG. 1 is a block diagram of a telecommunications terminal equipment with a speech synthesis device according to one exemplary embodiment of the invention.

For purposes of the presently described embodiments, the text analysis rules are to be understood as a set of rules which are processed in succession and which, as explained in more detail below, usually constitute language-specific rules which describe a customary mapping of specific parts of the electronic text onto one or more phonetic units.

If the text analysis rules are fulfilled or have been for the respective electronic text under examination, a first sequence of phonetic units is formed.

According to the invention, in particular the following units may be used as phonetic units for the subsequent concatenating speech synthesis:

- phoneme segments,
- phonemes,
- allophones,
- diphones,
- triphones,
- half syllables, in particular initial half syllables and final half syllables+rudimentary elements, suffixes,
- mixed inventories for covering coarticulation effects,
- words or
- a sequence of words.

In addition, the method according to the invention tests whether the electronic text is contained in an electronic abbreviation lexicon.

The abbreviation lexicon contains a mapping table of predefined abbreviations, encoded in the format in which the electronic text is present, and the associated phonetic transcription of the abbreviation, for example encoded in SAMPA, as a corresponding representation of the respective predefined abbreviation.

If the electronic text is contained in the electronic abbreviation lexicon, a second sequence of phonetic units is formed and said second sequence is assigned to the respective electronic abbreviation in the electronic text in the abbreviation lexicon.

In addition it is tested whether the electronic text is contained in an electronic functional word lexicon.

In this context, the electronic functional word lexicon is a mapping table with predefined functional words, again encoded in the respectively used electronic text format, and the phonetic units assigned to the respective functional word, said units being encoded in the respective phonetic transcription, preferably SAMPA, as a corresponding representation of the respective predefined functional word.

A functional word is to be understood in this context as a word which connects nouns or verbs to one another functionally, for example the words: "for", "under", "on", "with", etc.

If the electronic text is contained in the electronic functional word lexicon, a third sequence of phonetic units is formed corresponding to the associated entry in the electronic functional word lexicon.

If the text analysis rules for the electronic text are not fulfilled and the parts of the electronic text or the electronic text are not contained in the abbreviation lexicon or in the functional word lexicon, a fourth sequence of phonetic units is formed using an exception lexicon.

Exception character sequences which are predefined in a mapping table are stored, again with the possibility of being predefined by a user, in the exception lexicon, and the associated sequence of phonetic units, with a data tuple in turn containing two elements per data entry and with the first element of the data tuple being the respective term, encoded in the format of the electronic text, and the second element of the data tuple being the respective representation of the first element, encoded in the respective sound transcription.

In addition, for the respectively formed sequence of phonetic units, a prosody is generated using predefined prosody rules, and the speech signal, preferably the analog speech signal to be output, is then generated from the respective sequence of phonetic units and the prosody which is formed for the respective sequence of phonetic units.

A speech synthesis device for synthesizing a stored electronic text to form an analog speech signal has a text memory for storing the electronic text, and a rule memory for storing text analysis rules and for storing prosody rules.

In addition, a lexicon memory is provided for storing an electronic abbreviation lexicon, an electronic functional word lexicon and an electronic exception lexicon.

The speech synthesis device also has a processor which is configured in such a way that it carries out the method steps described above using the stored text analysis rules and prosody rules as well as the stored electronic lexicons.

Furthermore, a telecommunications device with a speech synthesis device according to the invention is provided.

As a result of the strictly modularized, rule-based approach using the respectively graduated electronic lexicons which are adapted to the respective language and in an optimized fashion, a speech synthesis is made possible with sufficiently good quality even in an embedded system with a very reduced storage space requirement.

The very easy scaleability in order to increase the achievable quality of the speech synthesis can also be considered a further advantage of the invention since the respective electronic lexicons and the rules can be expanded very easily.

Preferred developments of the invention emerge from the dependent claims.

According to one refinement of the invention, the phonetic units are stored in compressed form and at least some of the stored compressed phonetic units, in particular the compressed phonetic units which are required to form the sequence of phonetic units are decompressed before the formation of the respective sequence of phonetic units, in particular before the formation of the first sequence of phonetic units. As a result of the compression of the phonetic units, a further considerable reduction in the storage speech requirement is achieved.

Both compression algorithms which are loss free and compression algorithms which are subject to loss can be used as compression methods.

It has become apparent that in particular the following methods are very well suited for ensuring a high degree of compression of the data stock with only a small loss of quality:

ADPCM (Adaptive Differential Pulse Code Modulation),
GSM,
LPC (Linear Predictive Coding), or
CELP (Code Excited Linear Prediction).

Preferably diphones are used as phonetic units.

The method is preferably used in an embedded system, for which reason according to one embodiment of the invention the speech synthesis device is configured as an embedded system.

FIG. 1 shows a telecommunications terminal equipment 100 with a data display unit 101 for displaying information, an antenna 102 for receiving and emitting radio signals, a loudspeaker 103 for outputting an analog speech signal, a keypad 104 with input keys 105 for controlling the mobile telephone 100 and a microphone 106 for picking up a speech signal.

The mobile telephone 100 is configured for communication according to the GSM standard, alternatively according to the UMTS standard, the GPRS standard or any other suitable mobile radio standard.

In addition, the mobile telephone 100 is configured to transmit and receive textual information, for example SMS messages (Short Message Service messages) or MMS messages (Multimedia Service messages).

Figure 2:
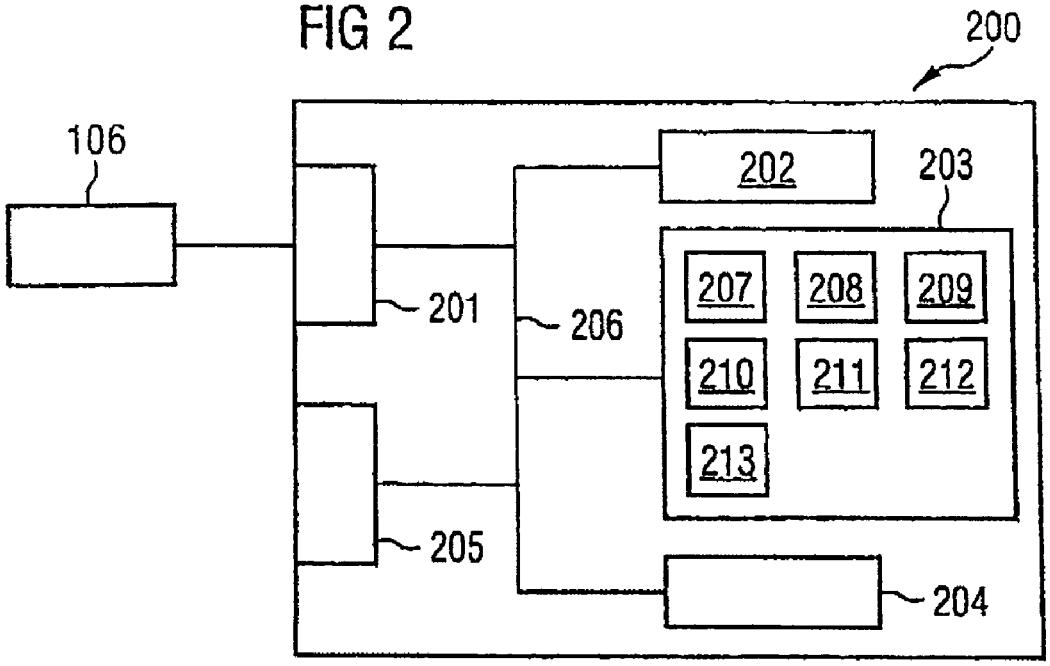
FIG. 2 is a block diagram which shows the individual components which are embedded in the telecommunications terminal equipment.

FIG. 2 is a block diagram showing the individual components which are integrated into the mobile telephone 100, in particular a speech synthesis unit which is explained in detail below and which is integrated into the mobile telephone 100 as an embedded system.

According to the block diagram 200, the microphone 106 is coupled to an input interface 201.

In addition, a central processor unit 202, a memory 203 and an ADPCM coder/decoder unit 204 are provided as well as an output interface 205. The individual components are connected to one another by means of a computer bus 206. The loudspeaker 103 is connected to the output interface 205.

When the compressed diphones in the diphone lexicon are decompressed, it is to be paid attention to that the decompression is carried out in real time in accordance with the ADPCM using the ADPCM coder/decoder unit 204.

The central processor unit 202 is configured in such a way that the method steps described below for carrying out speech synthesis as well as the method steps which are necessary to operate the mobile telephone, in particular to decode and encode mobile radio signals, are carried out.

In alternative embodiments there is provision for a separate computer unit to be provided, in particular for the speech synthesis, said unit being, for example, a computer card which is specially configured for the speech synthesis in order to relieve the central processor unit 202 which is provided for other tasks within the mobile telephone.

In one alternative embodiment, the mobile telephone 100 is additionally configured for speech recognition.

On the one hand, the computer programs 207 which are necessary for operating the mobile telephone 100 and, in addition, the corresponding text analysis rules 208 which are explained in more detail below as well as prosody rules 209, are stored in the memory 203. Furthermore, a plurality of different electronic lexicons are stored in the memory 203, according to this exemplary embodiment an abbreviation lexicon 210, a functional word lexicon 211 and an exception lexicon 212.

A predefined number of abbreviations which are customary for the respective language, for example the following expressions and the sequence of phonetic units which are associated with the respective abbreviation are stored in the abbreviation lexicon 210:

"bsp.", "bspw.", "etc.", "usw.", "u.a.", "d.h.", ("e.g.", "e.g.", "etc.", "and so on", "i.a.", "i.e.", . . . )

A predefined number of functional words and the illustrations which are associated with the functional words in phonetic transcription, in other words the sequence of phonetic units associated with the respective functional word, are stored in the functional word lexicon 211. For example, functional words provided in the German language are:

"für", "unter", "mit", "auf", . . . ("for", "under", "with", "on" . . . )

In each case a corresponding mapping onto a sequence of phonetic units is defined and stored in the exception lexicon 212 for specific predefinable textual units.

According to this exemplary embodiment diphones are used as phonetic units. The diphones which are used within the scope of the speech synthesis are stored in a diphone lexicon 213 which is also stored in the memory 203.

The diphone lexicon 213, which is also referred to as a diphone data stock or else as a data stock, contains, as stated above, the diphones which are used for speech synthesis, but according to this exemplary embodiment they are mapped at a sampling frequency of 8 kHz, as a result of which a further reduction in the amount of storage space required is achieved since a sampling frequency for the diphones of 16 kHz or even a higher sampling frequency is generally used, which is, of course, also possible according to the invention in an alternative embodiment of the invention.

According to this exemplary embodiment, the diphones are also encoded according to the ADPCM (Adapted Differential Pulse Code Modulation), and thus stored in compressed form in the memory 203.

As has already been described, it is alternatively possible to use an LPC method, a CELP method or else the GSM method to compress the diphones, and generally any compression method can be used which provides a sufficiently large degree of compression, while ensuring a sufficiently small amount of information loss owing to the compression, even for small signal sections. In other words, a compression method is to be selected which has a short transient recovery of the encoder and causes a small amount of quantization noise.

A speech synthesis of a text message which is stored in the memory 203 and is to be output as an analog speech signal will be explained with reference to the block diagram 300 in FIG. 3.

The electronic text which is stored is stored in an electronic file 301 and not only has preferably ASCII-encoded words but also special characters or control characters such as, for example, a "new line" control character or a "new paragraph" control character or a control character for formatting part or all of the electronic text stored in the electronic file 301.

For the purpose of speech synthesis, the electronic text is subjected to different preprocessing rules within the scope of a text processing operation (block 302). The processed electronic text 303 is subsequently fed to a module, i.e. to a computer program component for prosody control 304, in which, as is explained in more detail below, the prosody for the electronic text is generated.

Then, a component selection, i.e. a selection of phonetic units, is carried out for the electronic text 305 generated in this way, said selection being carried out using the data stock, i.e. using the diphone lexicon 213 whose compressed diphones 306 are ADPCM-decoded before the processing described below by means of the ADPCM coder/decoder unit 204 and being a selection of required diphones 307 (block 308) according to this exemplary embodiment. The selected diphones 307, i.e. generally the selected phonetic units, are fed to a computer program component for acoustic synthesis (block 309) and combined there to form a speech signal to be output, said speech signal which is to be output being firstly present in a digital form and being digital/analog converted to form an analog speech signal 310 which is fed via the output interface 205 to the loudspeaker 103 and is output to the user of the mobile telephone 100.

Figure 4:
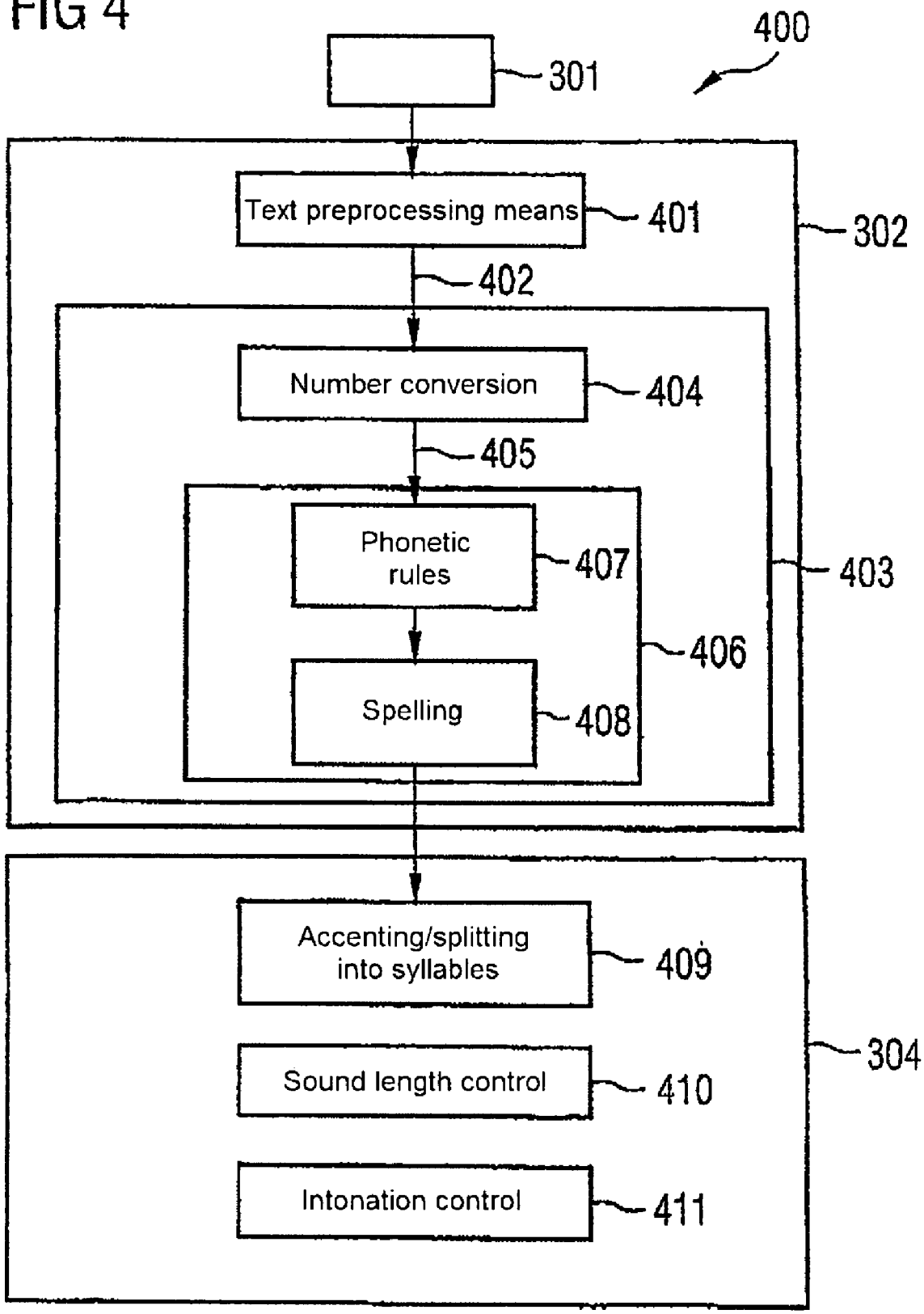
FIG. 4 is a block diagram in which the components of the text processing system and of the prosody control system are illustrated in greater detail.

FIG. 4 is a block diagram 400 showing the blocks of the text processing 302 and of the prosody controlling 304 in greater detail.

Within the scope of the speech synthesis, a sufficiently long electronic text is stored in the electronic file 301, said text being transferred into the processor unit 202 in a completely associated memory area. According to this exemplary embodiment, the electronic text has at least one partial sentence so that appropriate prosody generation is made possible.

According to this exemplary embodiment, if the respectively transferred electronic text from the electronic file 301 is shorter than a partial sentence, i.e. if no punctuation marks are determined within the transferred electronic text, the text is treated as a partial sentence and a full stop is artificially added as a punctuation mark.

The preprocessing of the text (block 401) has the function of adapting the electronic text which is input to the character set which is used internally within the scope of the speech synthesis.

For texts which originate from different sources, it is necessary to convert them to the internally used character set since, for example, the German umlauts are not associated with the same codes in all character sets. Furthermore, control characters are removed from the text.

Line advances in combination with hyphens are eliminated. For this purpose, a character table is made available which encodes formatting information for each character. The access to the table (not illustrated), which is also stored in the memory 203 is carried out by means of the numerical value of the character.

The following character classes are distinguished and stored in the table in the memory 203:

| | | |
|---|---|---|
| [0-9] | number | ZF |
| [a-z] | lowercase letter | KB |
| [A-Z] | uppercase letter | GB |
| [' ' '-' '\r\n' '\n' '\t'] | white character (word boundary) | WZ |
| [. , ; : ? !] | punctuation | IP |
| [* ' " # $ % & ' ( ) + − / < > . . . ] | special character | SZ |
| ['\n' '\r\n' '\t'] | control character | ST |

Control characters or characters which are not contained in the table are deleted from the electronic text which is input. The table is used by the two program components comprising the text preprocessing program component (block 401) and the "spelling" (block 408) program component which is described below.

The respective character class is encoded in a byte and the form of pronunciation of the character is added as a character chain, i.e. as a sequence of phonetic units, i.e. as a sequence of diphones according to the exemplary embodiment. Overall this results in a storage requirement of approximately 1 kbyte.

The input text 402 which is filtered by the text preprocessing device 401 is subsequently evaluated by means of a special text analysis rule mechanism within the scope of a grapheme-phoneme conversion (block 403), said text analysis rule mechanism being stored in the memory 203 and being used to detect various connections of numbers in the filtered input text 402 and convert them (block 404). Since numbers can contain not only sequences of numbers but also dimensional numbers or currency indications, the evaluation is carried out before the further decomposition of the filtered electronic text 402.

The filtered electronic text 405, which is examined for numbers, is subsequently divided into partial chains (i.e. words and sentences) using the tokenizer (block 406) program component. The partial chains are referred to below as tokens.

The tokens run through the lexical conversion means or the phonemic text analysis rule mechanism 407. If the token cannot be converted i.e. transferred into a phonemic sequence, i.e. into a sequence of phonetic units by a processing stage, the respective token is converted by spelling within the scope of the outputting process, i.e. the token is considered in the speech output as a sequence of individual letters and letters are correspondingly mapped onto a sequence of diphones for the individual letters and this sequence is output as a spelled-out chain of characters to the user by means of the "spelling" computer program component (block 408).

Using a special set of rules from the text analysis rules, numbers and number formats are detected within the scope of the numerical conversion 404 and converted into a sequence of phonetic units. At first, checking is carried out according to the numerical conversion text analysis rules to determine whether the chain of characters corresponds to a known sequence of numbers and additional information.

Examples of such number conversion text analysis rules for determining numbers and number formats are specified below using the phonemic transcription SAMPA:

| | | |
|---|---|---|
| "\Z{1900, 1999}" | , | "n0Yntse:nhUnd@6t\1{−1900,0}" |
| "\Z,\Z{0, 99} DM" | , | "\1{0} mark \2{0}" |

In this case, according to the expression "/Z{1900, 1999}" a number between 1900 and 1999 is searched for. If such a number is obtained, it is interpreted as the number of years and is correspondingly converted into a diphone sequence, and thus into a phoneme sequence. The conversion is thus carried out as a mapping onto a sequence of diphones as phonetic units and the space markers for the numbers which are obtained and which are converted by a second stage of the rule mechanism.

The number rules of the number conversion text analysis rules are implemented in such a way that there is a strict division between the control interpreter, which is language-independent, and the rules themselves, which are language-dependent.

It is to be noted in this context that the reading in and conversion of the text analysis rules from the text form and a binary format which is efficient in terms of storage are separate from the actual program according to this exemplary embodiment, as a result of which efficient handling of the text analysis rules is made possible during the running time.

In the definition of the conversion rules, there is a restriction to the most important numerical formats, again in order to save memory space. Conversely, cardinal numbers and ordinal numbers, the date and the time (including the appended token "o'clock") are converted. However, the addition of other formats is readily possible at any time by simply making additions to the number conversion text analysis rules.

If one of the rules for determining numbers and number formats is applicable, the character chain which is obtained is converted, in accordance with the text analysis rule 208, into the sequence of diphones which is assigned to the respective rule, in other terms the character chain which is found is replaced by the rule target. The rule target contains space markers for the numbers which are obtained and which have been converted by the second stage of the rule mechanism. There are a plurality of sets of rules there, for example for cardinal numbers, ordinal numbers or numbers of years, which have been called selectively by the rules of the first stage written above.

An overview of examples of process rules for the cardinal numbers is given below:

| | | | | | | |
|---|---|---|---|---|---|---|
| > 99, | %10, | = 0, | /100, | , | "\1{0}*hUnd@6t*", | "\1{0}*hundert*" |
| > 99, | , | , | /100, | %100, | "\1{0}*hUnd@6t*\2{0}", | "\1{0}*hundert*\2{0} |
| > 30, | &10, | = 0, | /10, | , | "\1{0}*sIC*", | "\1{0}*zig*" |
| = 30, | , | , | , | , | "*draIsIC*", | "*dreI*"*sig*" |
| > 20, | , | , | %10, | −0, | "\1{0}?*Unt*\2{0}", | "\1{0}*und*\2{0}" |

The number to be converted must firstly fulfill a condition, and otherwise the next text analysis rule is checked. It is also optionally possible to test a second condition for which the number can be changed in advance. Two numbers which are used in the rule target for ultimate conversion are then generated by arithmetic operations. A translation of the first rule illustrated above into colloquial language would produce, for example, the following:

"If the number is greater than 99, and the remainder given a modulus 10 operation is equal to zero, then set the auxiliary number 1 to the number divided by 100, convert it using the cardinal number rules and add the character chain "hUnd@6T" to the result.

Sample rules, i.e. the rules described above for the first stage and number rules, i.e. the rules of the second stage, contain an additional conversion into a natural language form in order to facilitate troubleshooting. In such a case, any desired messages can be generated in order to be able to follow the precise sequence of the creation of rules from the outside.

If a single punctuation mark is left after the conversion of the token, a sentence boundary is inserted at this point.

All the number formats which do not satisfy any of the existing number conversion text analysis rules are passed on in an untreated form and finally converted in the spelling mode 408 into a sequence of diphones—in which one letter is converted separately in each case—and into the analog speech signal 306 and output to the user.

Word boundaries are detected by the "tokenizer" program component, i.e. individual words are detected by means of the white characters located between them. Depending on the types of character, the token is either classified as a word (uppercase and lowercase letters) or as a special format (special characters).

In addition, sentence boundaries are marked at all those locations at which punctuation marks which are followed by blank characters are detected directly after a word. If a token which is not a number contains more than one special character, it is mapped into the analog speech signal by the lettering mode and output.

In addition, in the filtered electronic text those words or expressions which are contained in the abbreviation lexicon 210 and the functional word lexicon 211 are determined using said lexicons 210, 211, and the abbreviations or functional words which are obtained are converted into the corresponding sequence of diphones.

According to this exemplary embodiment, before searching for a token in the lexicons 210, 211 all the uppercase letters are converted into lowercase letters, the word class information "noun" being retained for words which are written with an initial capital. If the word is found in the respective lexicon 210, 211, replacement is carried out by means of its phonemic transcription, i.e. by means of the sequence of diphones, as explained above.

The structure of the lexicons is the same for all the stored entries:

the graphemic form of the word and the phonemic form with word accent marks and syllable boundary marks together with the word class are assigned.

According to this exemplary embodiment, the following word classes are differentiated for sufficiently correct accenting and phrasing:

| | |
|---|---|
| Noun | S |
| Verb | VB |
| Adverb | AV |
| Adjective | ADJ |
| Functional word | Fkt. |

The class functional word contains words which occur very frequently and therefore have a very small information content and are accented rarely, which property is utilized within the scope of the acoustic synthesis 309, as will be explained in more detail below.

The word classes are encoded in a byte for the purpose of later accenting and assigned to the respective word.

In addition, checking is carried out to determine whether the respective word or the respective expression is contained in the exception lexicon 212.

If the word is not contained in the exception lexicon 212, it is converted using the phonemic text analysis rule mechanism, the phonemic text analysis rules having the following structure:

XYZ→W

The phonemic text analysis rules are processed as follows:

Y is replaced by W if it occurs to the right of X and to the left of Z in the word which is to be transcribed. X, Z and W may be empty here or contain one to five characters or class symbols. Class symbols are space markers for a group of letters or sequences of letters, as defined in the following table:

| | |
|---|---|
| V = {a e i o u ä ö ü y} | # Vowels |
| B = {a o u} | # Rear vowels |
| D = {äu au ai ay ei ey eu} | # Diphthongs |
| C = {b c ch d f g h j k l m n p ph qu r s sch t v w x z β} | # Consonants |
| P = {b d g} | # Voiced plosives |
| K = {b d g p t k} | # Plosives |
| L = {l m n r} | # Liquids |
| T = {bb ck dd ff gg kk ll mm nn pp rr ss tt zz} | # Double consonants |
| S = {abel al alis ant anz ärin ator ell ent enz ett eur iant ibel iell ient in ion ismus ist istik istin itis iv ivum} | # Stressed derivation suffixes for nouns |
| N = {chen ler lein lich ling nis} | # Unstressed derivation suffixes for nouns |
| O = {ein ik isch ium ius um ung} | # Unstressed derivation suffixes for nouns |
| U = {ier} | # Derivation suffixes for verbs |
| E = {e em en es er ern n nen s ere erem eren erer eres ste sten} | # Endings |
| I = {e en est et ete eten etest etet n st t te ten test tet} | # Verbal endings |

X and Z may contain the characters "@" and "#", where "@" may be a space marker for any character, and "#" represents the word boundary.

The rules are arranged according to the first letter of the rule set so that in each case only a subset of all the rules have to be searched through. Within the respective section, the rules are ordered from the most specific to the most general, ensuring that at least the last rule is processed. When a rule can be applied, the system jumps from the processing of the rule, appends the result W of the rule to the sequence of phonemes which already exists for the current word, and the pointer is moved on to the character chain to be converted, by the number of characters in the rule set.

The efforts to provide an efficient way of representing the rule mechanism within the scope of the storage in the memory 203 is based on a number of 1254 rules. If all four parts of a rule are stored in a table with a fixed number of rows and number of columns, in each case on a row directly one behind the other, the length of the longest overall rule must be used as the width of the table, in this case 19 bytes. The access to the rules is very simple owing to the field structure, but there is a storage requirement of 23 kilobytes.

In one alternative variant, the rule components are packed tightly into an array, for which reason a further field of pointers with a length of 2500 bytes is required for the access, but the overall storage requirement is only 15 kilobytes.

If all the transcription attempts have failed, i.e. if the mapping according to the phonemic text analysis rules has not functioned either, the token is spelt by replacing each character by its corresponding phonetic representation and outputting it in a corresponding way. Owing to the resulting excessive lengthening of the text (substitution of each character by n new characters), the number of characters which can be spelt per token is limited to a maximum of ten according to this exemplary embodiment.

If the partial chain has been successfully converted into an uttered form, the sequence of phonemes is present as a sequence of phonetic units for said phonemes.

For the subsequent prosodic processing modules within the scope of the prosody controller 304, specifically the accenting and division into syllables (block 409), the length-of-sound controller (block 410) and intonation controller (block 411), it is important to know syllable boundaries and accent positions or types of accent which are acquired by means of the computer program component 409.

Some of this information is already contained in the phoneme sequence of the token if the latter has been generated using one of the lexicons 210, 211, 212 with the rules for converting numbers and number intervals or in the spelling mode. In this part, the aforesaid information is collected from the phoneme sequence.

If the syllable boundary information or accenting information is not yet available, it is generated by means of a further heuristic control mechanism which will be explained in more detail below.

The information from the phoneme table which is also stored in the memory 203 is used for parsing the phoneme sequence and classifying individual phonemes as a long vowel, short vowel, fricative etc. The phoneme table contains 49 phonemes and special characters (main accent and secondary accent, syllable dividers, pauses), and classification features (long vowel, short vowel, diphthong, consonant class etc).

The syllable division rules are based on the assumption that specific phonetic classes in all languages have similar functions owing to general physiological conditions. In order to carry out division into syllables, syllable nuclei and syllable nucleus types are firstly determined and the syllable boundary is determined within the intervowel consonant sequence according to heuristic rules.

An accent is assigned to the first syllable in the word with a long vowel or diphthong using the accenting rules. If none of these two syllable nucleus types are present, the accent is assigned to the first syllable with a short vowel.

Certain word accents are finally combined with a heuristic, the word class, distanced from the preceding sentence accent and positioned within the phrase, upgraded to a sentence accent. For the calculation of the speech rhythm of the synthesized speech, a sound-based rule mechanism according to Klatt/Kohler was implemented (described in Dennis H. Klatt, Synthesis by rule of segmental durations in English sentences, Frontiers of speech communication research, ed. B. Lindblom and S. Öhman, Academic Press, London, pp. 287-300, 1979 and Klaus J. Kohler, Zeitstrukturierung in der Sprachsynthese, in: Digitale Sprachverarbeitung, ITG-Tagung [Structuring of time in speech synthesis, in: Digital speech processing, ITG conference], Bad Nauheim, edited by A. Lacroix, VDE-Verlag, Berlin, pp. 165-170, 1988, both of which are hereby incorporated herein by reference in their entirety).

An initial sound length in milliseconds, which is different for each phonetic class and is stored in the phoneme table is modified by means of a rule mechanism which takes into account the various influencing factors.

Influencing factors which are used according to this exemplary embodiment are accent situations, adjacent sounds (coarticulation factors), position of the sound in the syllable and position of the syllable in the word and in the sentence. Other suitable criteria may of course be taken into account.

The initial sound length can be extended or shortened by means of factors assigned to the influences, with shortening being permitted only to a minimum length.

The sound length is calculated according to the following rule:

$$\text{Sound length}=k\cdot((D_{inh}-D_{min})\cdot Pr\ cnt+D_{min})$$

where k is a coarticulation factor, $D_{inh}$ is an inherent sound length, $D_{min}$ is a minimum sound length and Prcnt are global influencing factors.

The model provides a specific sound length for each sound, and provides the length of pauses at syntactic boundaries. Phase boundaries, sentence part boundaries and paragraph boundaries provide pauses with growing lengths.

A speech melody is calculated within the scope of the intonation control process 411 for the entire electronic text by means of the previously acquired sound length data from the program component sound length control (block 410) and the accenting information which has been acquired and the sentence type information which has been acquired from the grapheme/phoneme conversion 403. The following model, which fulfils the following requirements, is used for this:

- accents are audible,
- phrasal and functional structures are audible (pauses, melody contours),
- there is a reproduction of natural variability and
- a neutral intonation is ensured since understanding of the text is absent.

According to the model used, intonation contours from linear component parts (cf. FIG. 5*a* to FIG. 5*d*) are put together by additive superimposition.

Accent-based components and phrase-based components are differentiated in the process.

The phrase-based component is formed using the knowledge that over each phrase the basic frequency drops continuously from the start to the end of the phrase (declination). The interval width of the basic frequency movement is freely selectable as a control variable of the model.

Figure 5A:
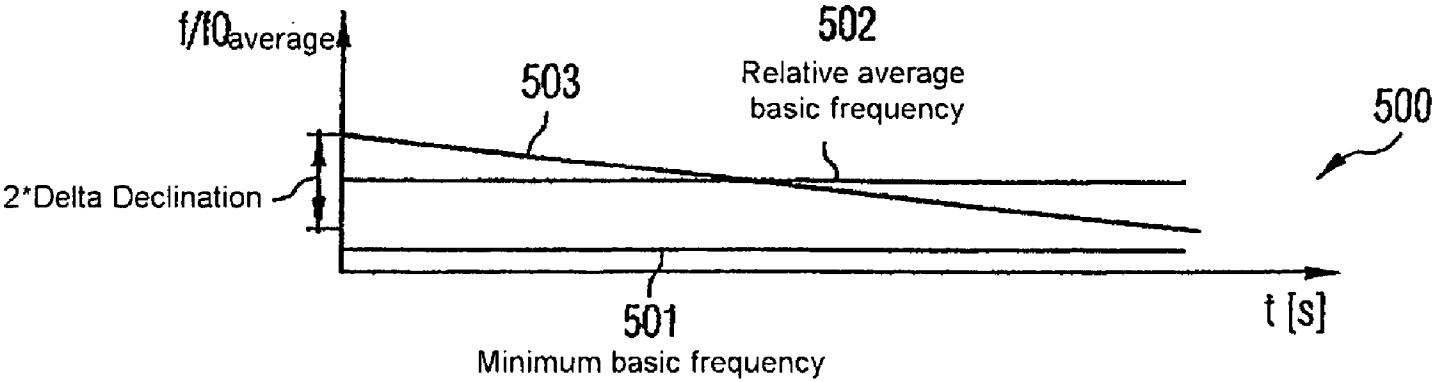
FIGS. 5A to 5D show outlines of individual components of an intonation model as well as the additive superimposition thereof to form an overall intonation contour according to one exemplary embodiment of the invention.

FIG. 5*a* shows a minimum basic frequency 501 and a relative average basic frequency 502 in a time diagram 500, together with the profile 503, the basic frequency plotted over time.

In order to form the sentence-type-based components, the recognition that, at the end of each phrase, the declination line is linked to a final movement which is typical of the phrase depending on the type of the sentence to be realized (statement, continuation, exclamation, question) is used.

This movement extends from the position of the last sentence accent in the phrase to the end of the phrase, the maximum, however, over the last five syllables of the phrase.

Provision of information and exclamation bring about an additional lowering of the basic frequency toward the end of the phrase, continuation sentences and a phrase boundary bring about a slight rise in the basic frequency, and a question brings about a pronounced rise in the basic frequency toward the end of the phrase.

The value range of these phrase-final movements can be freely selected within the scope of the model.

Figure 5B:
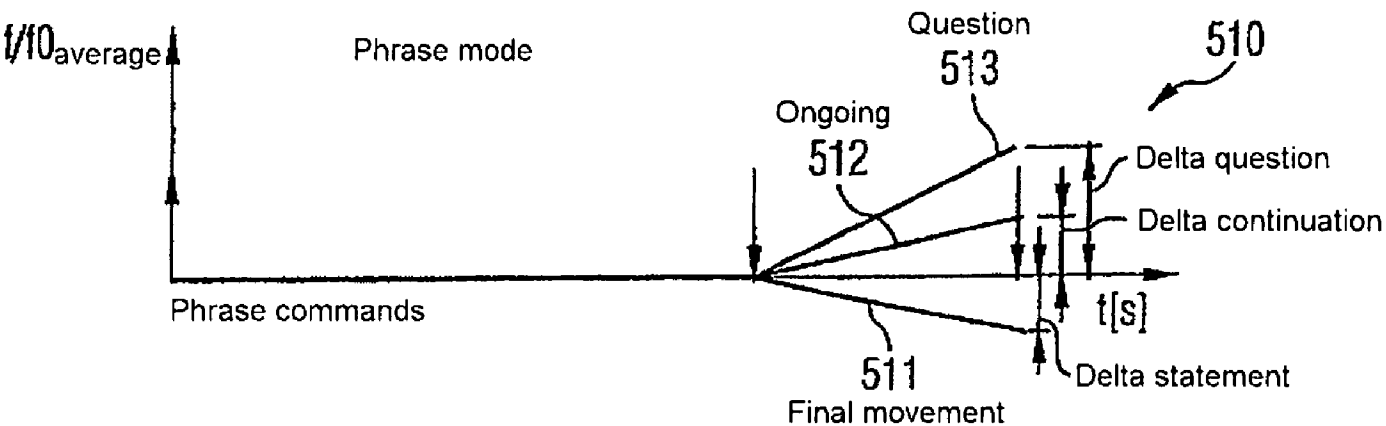

FIG. 5*b* shows, in a second time diagram 510, the basic frequency profile toward the end of the phrase for different sentence types. A first basic frequency profile 511 represents the final movement, a second basic frequency profile 512 represents an ongoing movement, i.e. a continuation sentence, and a third basic frequency profile 513 represents a question.

In addition, an accent-based component is taken into account as a component for the entire prosody, making use of the recognition that in the event of a syllable having a sentence accent the basic frequency is raised over the entire syllable and lowered again to the declination line over the duration of the following syllable. The level of the accent can in turn be selected as a control variable of the model, in a way which is freely adapted to the application.

Figure 5C:
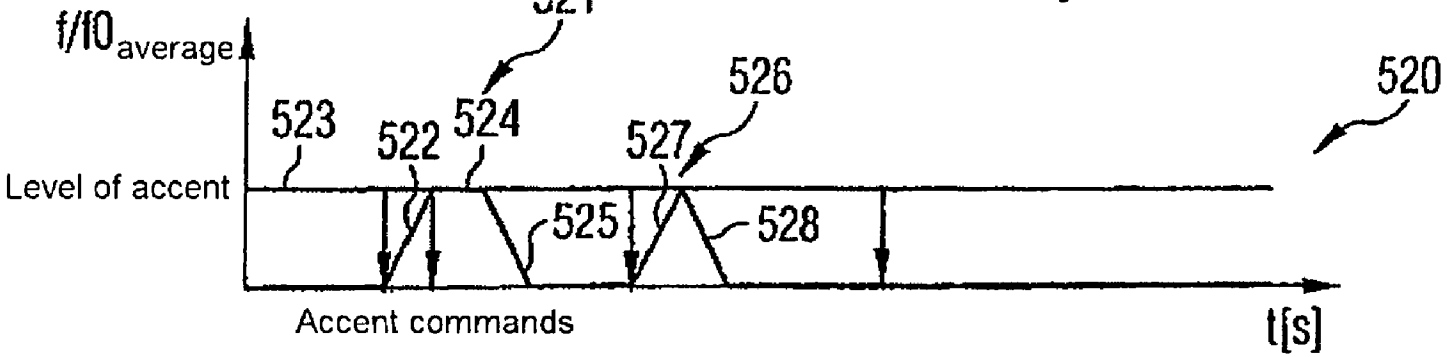

FIG. 5*c* shows, in a third time diagram 520, such accenting for different syllables, a first accent component 521 which is composed of three areas, with the basic frequency being raised to the level 523 of the accent from the declination line in a first rising area (in a first time period 522), is maintained at said level 523 of accent during a second time period 524 and only returned to the declination line again in a third time period 525.

A second accent structure 526 is formed from only two time periods, the rising branch 527, in which the basic frequency is increased to the level 523 of accent from the declination line, and the falling branch 528, according to which the basic frequency is continuously reduced again to the declination line (second time period 528) directly after the level 523 of accent has been reached.

Figure 5D:
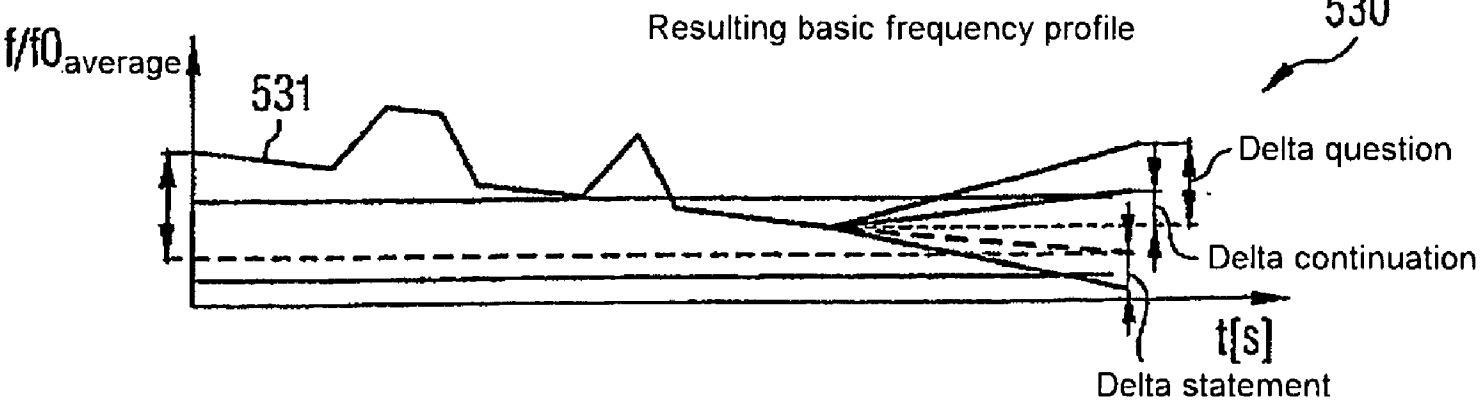

FIG. 5*d* shows an overall prosody 531 in a fourth time diagram 530, with the overall prosody representing the additive superimposition of the individual components represented in FIG. 5*a* to FIG. 5*c*.

After the calculation of the overall prosody, i.e. the overall contour 531, in each case a value is assigned, in accordance with the overall prosody which is determined, to each phoneme which is involved, i.e. to each phoneme in the word chain for which the overall melody has been determined.

The intonation contour is then reproduced within the scope of the acoustic synthesis 309 by interpolating linearly between the phoneme-based reference points.

In one alternative configuration of the invention there is provision for a linguistically motivated accenting algorithm to be used for the accenting of words.

According to the exemplary embodiment described above, the accent is placed on the first long vowel, or on the first short vowel of the word if no long vowel can be found.

In this context, usually only nouns are considered, and other types of word are considered only if the last word accent occurred a long time before, in order to avoid a monotonous pronunciation.

Functional words occur very frequently and are basically not stressed in view of a certain degree of redundancy.

In one alternative embodiment, the following set of four rules is used as the basis:

lengthening of the "heavy" final syllable, penultimate rule, rule of the next syllable which can be stressed and approximation rule.

In contrast to the solution described above, the word syllables are considered from right to left, i.e. starting at the end syllable of the word.

If the end syllable is a "heavy" syllable, the stress (1) is otherwise shifted to the penultimate syllable. If the penultimate syllable can be stressed, that is to say is not a "shwa" syllable, said syllable is stressed, otherwise in each step there is a shift forward in the direction of the start of the word by one syllable until a stressable syllable has been found or the start of the word has been reached.

The differentiation of the syllables into the phonetic categories of "heavy syllables", "light syllables" and into "shwa syllables" is made according to the definitions given in Caroline Fery, German Stress in Optimality Theory, Journal of Comparative Linguistics, pp. 101-142, 1998 and Petra Wagner, Systematische Überprüfung deutscher Wortbetonungsregeln [Systematic checking of German word stress rules], in W. Hess, K. Stöber (Editors), Elektronische Sprachsignalverarbeitung [Electronic speech signal processing], Conference papers from the 12th Conference 2001, pp. 329-338, 2001, both of which are hereby incorporated herein by reference in their entirety.

Shwa syllables are syllables which contain one of the shwa sounds "@", "n=", "m=" or "N=".

Syllables which do not have a coda, that is to say end in a vowel, are basically light syllables. If the coda is composed of two or more consonants, it is a heavy syllable.

The case when the coda is composed of precisely one consonant is more complicated. In this case, on the basis of the syllable nucleus it is decided whether it is a light syllable (with a short vowel as the syllable nucleus) or a heavy syllable (with a long vowel or diphthong in the syllable nucleus).

Using the phonological CV representation in which "stretched" (long) vowels are represented as VV and "non-stretched" vowels are represented as V and consonants as C, this can be summarized as follows:

| | |
|---|---|
| shwa syllables: | @, n=, m=, N= as nucleus, |
| light syllables: | C+VV, C+VC and |
| heavy syllables: | C+VVC+, C+VCC+, |

where C+ stands for one or more consonants.

The start of the syllable (onset) plays no role in the determination of the weighting of the syllable.

In addition, in an alternative embodiment there is provision for the intensity of the speech synthesis to be controlled. The intensity parameter is generated by preprocessing and is used to influence the dynamic range (and thus the naturalness) of the speech-synthesized-signal.

Said preprocessing is carried out periodically after the concatenation with the so-called PSOLA algorithm or a suitable derivative of this method. The individual sampled values of the speech-synthesized signal are multiplied by a factor which adjusts the signal to the desired target intensity (in dB).

This process is carried out according to the following rule:

$$s_{Pu}(i) = s_{Pu}(i) \cdot 10^{\frac{I_{Pu}}{20\ \mathrm{dB}}}.$$

Here, $s_{Pu}(i)$ represents the i-th sampled value of the p-th period of the speech component u to be synthesized. The desired intensity $I_{Pu}$ is newly calculated for each period p of the phonetic component u by the target intensities of the speech signal which are predefined at the reference points being interpolated linearly between these reference points.

The method in which the intensity control functions is thus comparable with the method of functioning of the basic frequency control which was described above. The respective reference points of the intensity control and of the basic frequency control may be freely selected independently of one another.

The target intensities are specified in the unit [dB]. A target intensity of 0 dB does not give rise to a change in the sampled values of the signal components. The target intensities to be set form an indication of the relative change in the intensity of the data stock modules. That is to say it is advantageous to use data stock with balanced intensity profiles.

Figure 3:
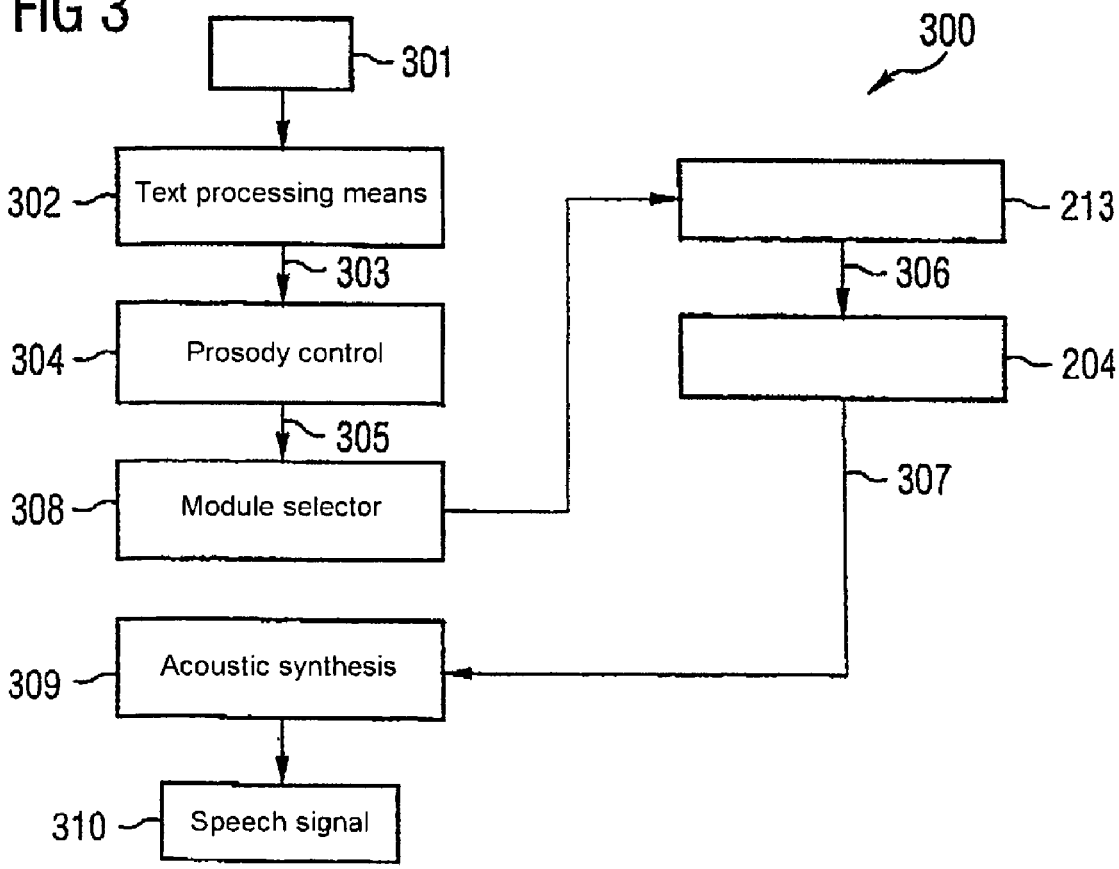
FIG. 3 is a block diagram in which the individual components for speech synthesis according to one exemplary embodiment of the invention are illustrated.

The module selector 304 which is represented in FIG. 3 will be explained in more detail below.

The function of the module selector 304 is to determine and select the suitable modules from the data stock or the data stock description as a function of the symbol sequence (phoneme sequence or syllable sequence) supplied by the preprocessing means, according to the exemplary embodiment to determine and select the suitable diphones for the acoustic synthesis.

The module sequence which is generated in this way is provided with prosodic addition information such as is explained above (length of sound, basic frequency profile) which has been generated by the preprocessing means.

In order to illustrate the module selection process in a simplified way, different data structures are defined below at the interfaces of the individual components.

The preprocessing means creates an array of the data structure SMPROS and fills it with the necessary data. The structure is specified below in a pseudocode:

```
Struct GF {
    int             fn;
    int             tn;
};
struct SMPROS {
    int             anzEI;
    char**          EI;
    char*           laut,
    int             dauer;
    int             gtAnz;
    struct GF*      gf;
};
```

Each element of the array contains the information for a symbol (phoneme, syllable, . . . )

An array structure of the data structure SM is generated by the module selector and transferred to the acoustic synthesis means.

The data structure SM is as follows:

```
struct SM {
    int                 anzEI;
    char**              EI;
    char*               unit;
    int                 anzLaute;
    struct SMPROS**     laut;
```

The component unit contains the name of the module, anzLaute the number of symbols (phonemes, syllables, . . . ) which are contained in the module. All the other components are transferred from the data structure SMPROS to the preprocessing means.

The array of the data structure INV contains the description data for an data stock. Before the start, the array is read from the corresponding binary file of the data stock to be used.

The structure INV is as follows:

```
struct INV {
    char    kanon [MAX_UNIT_LENGTH] ;
    long    startBin;
    int     anzPer;
    long    startPm;
    int     anzLaute;
    int*    lastPer;
};
```

Each element of the array INV contains the data of a phonetic module. The elements are sorted according to the initial symbol of the element kanon of the structure, according to the number of symbols contained in the module (phonemes, syllables, . . . ) and according to the length of the element sequence kanon of the structure (in this sequence). This permits effective searching for the required module in the array.

Figure 6:
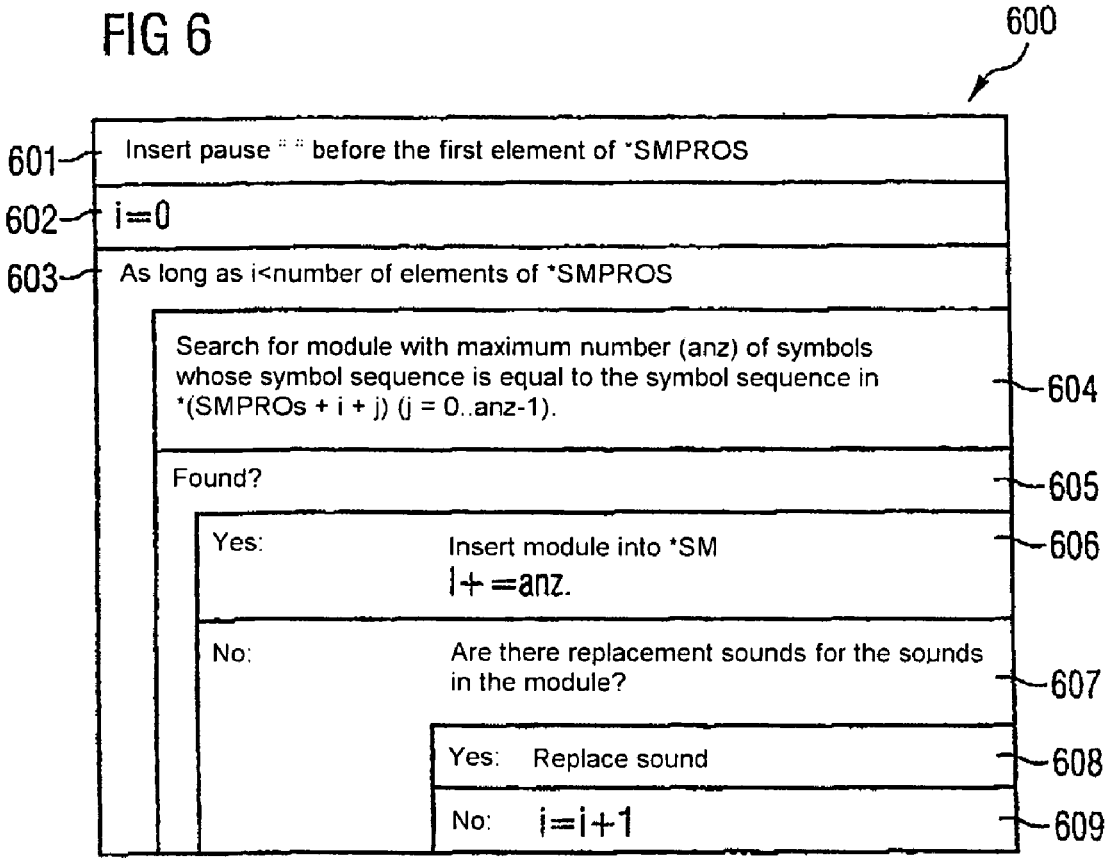
FIG. 6 is a structogram in which the individual method steps for selecting components according to one exemplary embodiment of the invention are illustrated.

FIG. 6 shows the procedure of the module selection according to the exemplary embodiment of the invention in a structogram 600.

In a first step 601, a pause with a length zero is inserted before the first element which is identified by the cursor *SMPROS. This is used to find the start module in the data stock. The variable i is then initialized to the value 0 (step 602), and the following steps are carried out in a first intonation loop 603 for all the elements of the respective SMPROS structure (all the sounds). In the data stock, the longest sound sequence which is adapted to the element sequence at the current position i of the structure is determined (step 604).

If such a module has been found (step 605, step 606), the module is added to the data structure SM, and the variable i is increased by the value anz of the maximum number of symbols whose symbol sequence is equal to the symbol sequence in *(SMPROS+i+j).

In addition checking is performed to determine whether there are replacement sounds for the sounds contained in the module (test step 607) and if such a replacement sound exists the sound is replaced (step 608). Otherwise, the value of the variables i is increased by the value 1 (step 609) and the iteration loop of the steps 604 to 609 is run through again for the new value of the variable i until all the elements of the SMPROS structure have been tested.

This clearly means that if a module with the corresponding sound sequence has been found, the module is added to the SM structure and the current position of the SMPROS structure is increased by the number of the sounds in the module which is found.

The acoustic synthesis 309 will be explained in more detail below.

The function of the acoustic synthesis 309 is to concatenate the signal sections in accordance with the presetting of the module selection.

Within the scope of the concatenation, the basic frequency and the sound length are manipulated by means of the PSOLA algorithm.

The input variable of the acoustic synthesis 309 is the SM structure which is generated by the "module selector" 308 program component. The SM structure contains the modules to be concatenated and the information relating to the basic frequency and the sound length which have been generated by the preprocessing means.

Figure 7:
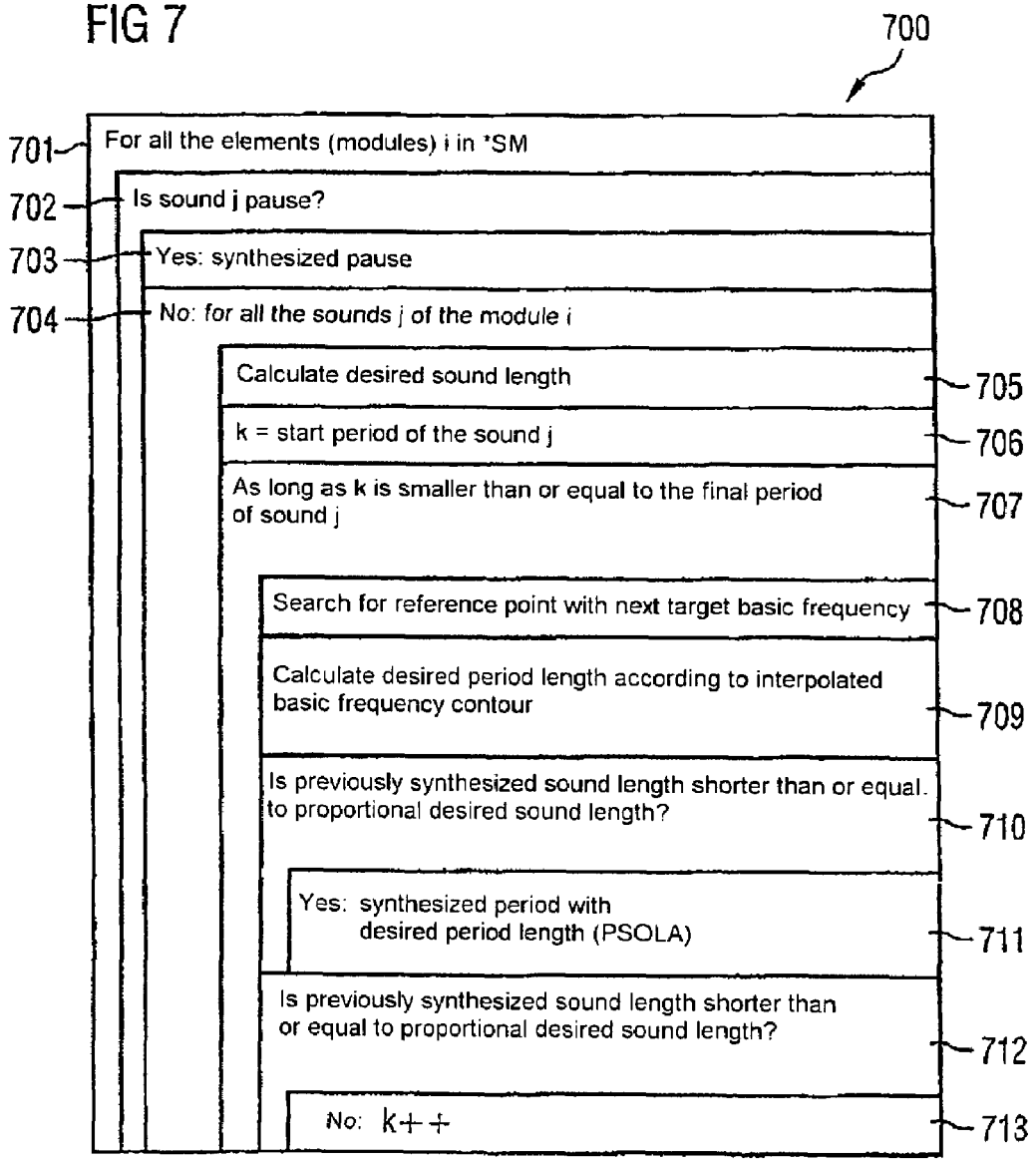
FIG. 7 is a structogram in which the individual method steps for the acoustic synthesis according to one exemplary embodiment of the invention are illustrated.

In the structogram 700 in FIG. 7, the individual method steps of the acoustic synthesis 309 are represented.

Within the scope of the acoustic synthesis 305, all the sounds of the requested module are periodically synthesized, i.e. an external loop 701 is run through for all the elements i in the structure SM.

In a first step, checking is carried out in each case to determine whether the sound j represents a pause (step 702).

If this is the case, the pause is synthesized as a speech signal (step 703).

However, if this is not the case, the following intonation loop 704 is carried out for all the sounds j of the module i.

In a first section of the intonation loop 704 (step 705), the desired sound length is calculated.

The value of the starting period of the sound j is then assigned to the variable k (step 706).

As long as the value of the variable k is smaller than or equal to the final period of the sound j (checking step 707) the following method steps are carried out:

In a step 708, a reference point with the next target basic frequency is determined (step 707).

The desired period length is then calculated according to the interpolated basic frequency contour (step 709).

Checking is then carried out to determine whether the previously synthesized sound length is shorter than or equal to the proportional desired sound length (step 710), and if this condition is fulfilled the period with the desired period length is synthesized according to the PSOLA algorithm (step 711).

Then, testing is carried out again to determine whether the sound length synthesized up to now is shorter than or equal to the proportional desired sound length (step 712).

If this is not the case, the value of the variable k is incremented by the value 1 (step 713).

This procedure clearly means that, depending on the insertions and emissions of periods, different periods are superimposed by means of the PSOLA algorithm, and otherwise the period with itself.

The basic frequency contour is determined from the desired period lengths which are obtained by means of the PSOLA algorithm. The predefined sound lengths are obtained approximately by means of insertions and omissions of periods.

The signal sections, i.e. the modules, are stored successively in the memory (short*). The information about the start sampled values of the modules, the number of periods, the start sampled values of the periods, etc. is stored in the structure INV, and the information about the number of sampled values of each period is stored in the structure PERIODE, which is structured as follows:

```
struct PERIODE {
    short           perLen;
    unsigned char   anreg;
    unsigned char   dummy;
};
```

We claim:

1. A method for performing computer-aided speech synthesis of stored electronic text to form an analog speech signal, comprising:

performing text analysis on the stored electronic text using predefined text analysis rules;

forming a first sequence of phonetic units after performing the text analysis rules for the electronic text;

testing whether the electronic text is contained in an electronic abbreviation lexicon; forming a second sequence of phonetic units if the electronic text is contained in the electronic abbreviation lexicon; testing whether the electronic text is contained in an electronic functional word lexicon;

forming a third sequence of phonetic units if the electronic text is contained in the electronic functional word lexicon;

forming a fourth sequence of phonetic units using an exception lexicon for any text of the stored electronic text upon which any of the foregoing forming steps were not applied;

generating a prosody for the respective sequence of phonetic units using predefined prosody rules; and generating analog speech signals from the respective sequence of phonetic units and the prosody, wherein the phonetic units are stored in compressed form, and wherein at least some of the stored compressed phonetic units are decompressed before the formation of the respective sequence of phonetic units.

2. The method of claim 1, wherein a method of compressing the phonetic units is selected from the group of compression methods consisting of ADPCM, GSM, LPC, and CELP.

3. The method of claim 1, wherein diphones are used as phonetic units.

4. The method of claims 1, wherein the recited steps are utilized in an embedded system.

5. A speech synthesis device for synthesizing a stored electronic text to form an analog speech signal, the speech synthesizing device comprising:

a text memory for storing the electronic text;

a rule memory for storing text analysis rules and prosody rules;

a lexicon memory for storing an electronic abbreviation lexicon, an electronic functional word lexicon and an electronic exception lexicon; and a processor configured to execute the following steps using the stored text analysis rules and prosody rules and the stored electronic abbreviation lexicon, electronic functional word lexicon and electronic exception lexicon:

subjecting the stored electronic text to a text analysis using the text analysis rules;

forming a first sequence of phonetic units if the text analysis rules for the electronic text are fulfilled;

testing whether the electronic text is contained in the electronic abbreviation lexicon;

forming a second sequence of phonetic units if the electronic text is contained in the electronic abbreviation lexicon;

testing whether the electronic text is contained in the electronic functional word lexicon;

forming a third sequence of phonetic units if the electronic text is contained in the electronic functional word lexicon;

forming a fourth sequence of phonetic units using the exception lexicon for electronic text for which none of the text analysis rules for the electronic text are fulfilled;

generating a prosody for the respective sequence of phonetic units using the prosody rules; and generating an analog speech signal from the respective sequence of phonetic units and the prosody, wherein the phonetic units are stored in compressed form, and wherein at least some of the stored compressed phonetic units are decompressed before the respective sequence of phonetic units is formed.

6. The speech synthesis device of claim 5, wherein the device is configured as an embedded system.

7. A telecommunications device having a speech synthesis device asin claim 5.

* * * * *